US006651275B1

(12) United States Patent
Rummell

(10) Patent No.: US 6,651,275 B1
(45) Date of Patent: Nov. 25, 2003

(54) PORTABLE FOLDABLE CRIB

(75) Inventor: Donald Dean Rummell, Midland City, AL (US)

(73) Assignee: Generation 2 Worldwide, LLC, Dothan, AL (US)

( * ) Notice: Subject to any disclaimer, the term of this patent is extended or adjusted under 35 U.S.C. 154(b) by 0 days.

(21) Appl. No.: 10/140,563

(22) Filed: May 7, 2002

(51) Int. Cl.[7] ..... A47D 7/00; A47D 7/02
(52) U.S. Cl. ..... 5/99.1
(58) Field of Search ..... 5/99.1, 93.1, 100

(56) References Cited

U.S. PATENT DOCUMENTS 4,765,004 A 8/1988 Kessel ..... 5/99.1
6,014,781 A 1/2000 Cone, II ..... 5/99.1

OTHER PUBLICATIONS

1980 Hedstrom Wood Products Catalog showing portable crib with collapsible frame (2pp.).
1985 Hedstrom Juvenile Products Catalog showing portable crib with collapsible frame (4pp.).
1986 Hedstrom Wood Products Catalog showing portable crib with collapsible frame (4pp.).
1988 Hedstrom Wood Products Catalog showing portable crib with collapsible frame (4pp.).
Photograph of Delta portable crib (1) partly folded with no means to store loose side; and (2) hinge and mattress support. (1p.) (undated).

*Primary Examiner*—Alexander Grosz
(74) *Attorney, Agent, or Firm*—Kenneth M. Bush; Robert M. Jackson; Bush IP Law Group, LLC

(57) ABSTRACT

A foldable portable crib comprises a pair of opposing side assemblies and a pair of opposing end assemblies supporting a mattress therebetween to form a crib frame. A mattress support platform is pivotally mounted to a pair of first corner posts, and moveable from an open, generally horizontal position to a folded, generally vertical position. In the folded position, the mattress support platform is positioned from a first side assembly a sufficient distance to stow a mattress and detached second side assembly therebetween. A portion of the end assembly is pivotally moveable about first corner posts for folding against the mattress support platform. A curved hinge joint and hinge brackets are provided for enhanced stability of the crib in its open, usable position. In the folded position, the portable crib is in a unitary, compact, and freestanding configuration.

32 Claims, 8 Drawing Sheets

PORTABLE FOLDABLE CRIB

BACKGROUND AND SUMMARY OF INVENTION

The present invention relates to juvenile cribs and more particularly, to portable juvenile cribs. With greater particularity, the present invention relates to foldable, free-standing portable cribs.

Portable juvenile cribs, or portacribs, are cribs that collapse or fold when not in use to allow the crib to be readily transported and stored. A significant advantage that portable cribs have over full-size cribs is portable cribs require much less storage space. Portable cribs can also be more easily transported, such as from a location where the portable crib is used and a location where the portable crib is stored when not in use. Because of these advantages, portable cribs are utilized extensively by hotels and motels in furnishing juvenile cribs needed by customers on a temporary basis.

In some homes and apartments, the use of a portable crib may be desired over full-size cribs because portable cribs may be conveniently moved from room to room as needed, or readily stored when not in use. Additionally, portable cribs have the significant advantage in comparison to full-size cribs of being configured for placement in vehicles when not in use. Unlike a full-size crib, a portable crib can be transported along with a child to a relative's home, a babysitter's home, or a child's day care facility.

Although the use of portable cribs offers many advantages, conventional portable cribs are widely perceived to be acceptable for only temporary use. As a result, portable cribs are generally not recommended for use as a child's permanent crib. Inherent limitations in the design of conventional portable cribs have fostered the widespread belief that portable cribs are not suitable for the rigorous wear and tear of daily crib use. Two characteristics of conventional portable cribs contribute to these negative perceptions. One is related to the ease with which the portable crib can be folded, unfolded, transported, and placed in storage. Consumers are likely to consider portable cribs that are difficult to fold and store to be inconvenient, and unacceptable for everyday use.

Another characteristic of portable cribs that is of paramount importance is the sturdiness of the crib after it has been setup for use. Generally speaking, a portable crib is only acceptable for everyday use if it is comparable in sturdiness and strength to a full-size crib. Conventional portable cribs are not sturdy enough to provide a sense of safety and security comparable to full-size cribs.

There are several inherent problems with the conventional designs and configurations of portable cribs. For instance, one popular design for conventional portable cribs provides a crib having opposing hinged sides that fold inwardly. As the sides of these cribs of this configuration are folded, a progressively narrower V-shape is formed. Should such a crib unintentionally collapse, there is a risk that a baby would become accidentally entrapped in the "V" portion of the crib. Another problem related to stability is that the hinges of these cribs are generally centrally located in the respective upper and lower rails of the hinged side assembly, with the ends of the respective rails pivotally attached to the comer posts. Cribs of this design have a plurality of hinges and hinge locations that allow for the possibility of undue flexing at the hinge locations, making the crib inherently unstable.

Another conventional design for portable cribs is a crib having a detachable side assembly, a stationary side assembly, a mattress platform that folds upwardly against the stationary side assembly, and ends that pivotally fold against the mattress platform. This design folds into two sections, the first being the detached side assembly and the second being the stationary side assembly, mattress platform and end assemblies. One of the inherent limitations of this design is the folded crib is difficult to move and store, on account of the necessity to transport two assemblies, namely, the folded portion of the crib and the detached side assembly. This crib does not have a means for stowing the loose side. The "floating" nature of the detached side assembly is a significant detriment to the portability characteristics of this conventional portable crib. Cribs of this design do not fold into a unitary configuration, so an excessive amount of storage space is required. Other limitations associated with this design are hinges that create unacceptable pinch points or catch points, and hinge locations that do not provide a smooth transition between rails and comer posts. Conventional portable cribs of this type do not have hinge structures that provide sufficient bracing support and locking features to provide assurances comparable to full-size cribs that portable cribs in an open position will not inadvertently collapse during use. These conventional portable cribs utilize hinges that present the possibility of undue flexing. These conventional portable cribs are difficult to move and store, and not sturdy enough for daily crib use. For these reasons and in view of these limitations, consumers perceive portable cribs negatively, as not providing sturdy construction comparable to full-size cribs.

Therefore, the need exists for an improved portable crib that addresses the limitations of the prior art. The need exists for a portable crib that folds into an acceptably small, or tight, unitary configuration for enhanced portability and improved storage characteristics; and a sturdy portable crib with enhanced stability characteristics acceptable for the rigors of day-to-day use.

SUMMARY OF THE PRESENT INVENTION

With the foregoing in mind, it is the principal objective of the present invention to provide a portable crib that provides the safety and comfort of a full-size crib.

Another object of this invention is to provide a portable crib that folds into a unitary, freestanding configuration requiring minimal storage space.

It is a further object of this invention to provide a portable crib that is simple to fold into compact folded position, and unfold into an open position.

A still further object of this invention is to provide a portable crib that has an improved folding mechanism.

Another object of this invention is to provide a portable crib with enhanced stability characteristics.

An additional object of this invention is to provide a portable crib having a detachable side assembly and a means for stowing the detachable side assembly when the crib is in a folded position.

Another object of this invention is to provide a portable crib that unfolds to form a crib having a smooth transition from the top end rails to the corner posts without pinch or catch points.

These and other objects of the present invention are accomplished through a freestanding portable crib that can be set up to form a sturdy and safe baby crib and, when not in use, folded into a compact configuration for transportation and storage. The foldable portable crib comprises a pair of opposing side assemblies connected to a pair of opposing end assemblies to form a baby crib frame. The frame is provided for supporting a mattress to provide a juvenile crib.

The present invention has a first side assembly and a second side assembly, both of which have an upper rail and lower rail connected by a plurality of slats. The side assemblies are connected to the end assemblies utilizing guides, or glides, connected to the ends of the side assemblies, which slidably receive tracks attached to the inner surface of the end assemblies. The first side assembly may function as a drop side of the crib, moveable along the tracks from an upper position to a lower position. The corner posts terminate in feet that may be configured in the form of swivel caster wheels, which provide for easy mobility of the folded crib. Each end assembly comprises a top end rail and a bottom end rail connected by a plurality of slats. In the preferred embodiment, the corner posts terminate in feet configured in the form of swivel caster wheels, which provide for easy mobility of the folded crib.

The invention further comprises a mattress support platform positioned between the first and second side assemblies and the end assemblies with the portable crib in the open position. The invention further comprises means for pivotally mounting the platform to the crib frame, so that the mattress platform may be moveable from an open, generally horizontal position to a folded, generally vertical position. The mattress platform is pivotally mounted on one side to a pair of first corner posts, and supported at the opposing side by a pair of second corner posts when the crib is in an open position.

The present invention may be folded by detaching one side assembly, the second side assembly, from the end assemblies, which is accomplished by lifting the second side assembly off of its respective tracks. The mattress support platform may then be pivotally moved from its open or horizontal position to a folded, vertical position wherein an upper surface of the mattress support platform is facing the inside surface of the attached side assembly, or first side assembly. In the folded position the distance between the mattress support platform and first side assembly must be sufficient to allow placement of the detached, second side assembly and the mattress therebetween. The detached second side assembly and mattress may then be stowed between the mattress support platform and first side assembly so that the folded crib is in a unitary configuration.

The present invention further comprises hinge means for pivotally moving a portion of the end assemblies about the first corner posts. The portion of the end assemblies that is pivotally moveable about the first corner posts, otherwise referred to as an end rail assembly, comprises an upper end rail and a lower end rail connected to a second corner post. Hinge means are provided for connecting the end rail assemblies to the first corner posts so that the end rail assemblies are pivotally moveable from an open position to a folded position wherein the end assemblies are folded against the lower surface of the mattress support platform. The end rail assemblies may be folded in overlapping relationship. The preferred embodiment of the present invention may also further comprise means for securing the end assemblies in the folded position, such as straps connected to the lower surface of the mattress support platform. In this manner, the present invention is folded to assume a unitary, generally narrow configuration that facilitates movement and storage of the folded crib.

The present invention further comprises means for stabilizing the end assemblies and corner posts when the end assemblies are in an open position. This provides enhanced stability characteristics, so that the crib may be sturdy enough to provide a safe crib that can withstand the rigors of day-to-day use. Means for stabilizing is comprised of a curved hinge joint having a curved portion formed in one end of the upper end rail that matingly engages a curved portion in the first corner post. The hinge joint stabilizes the end rail assemblies when the crib is in an open position, locking the end rail assembly securely into an open position and preventing the possibility of undue flexing at the hinge location. This locked position is maintained by connecting the second side rail assembly to the end assemblies. The hinge joint in the open, secured position forms a continuous surface between the upper end rail and the first corner post, eliminating dangerous pinch and catch points. The hinge joint of the present invention provides an improved folding mechanism that enhances the rigidity and stability characteristics of the crib in the open, usable position.

The present invention overcomes the limitations of the prior art. Additional features and advantages of the invention will become apparent to those skilled in the art upon consideration of the following detailed description of the preferred embodiment of the invention exemplifying the best mode of carrying out the invention as presently perceived.

BRIEF DESCRIPTION OF THE DRAWINGS

A portable crib embodying the features of the present invention is depicted in the accompanying drawings which form a portion of this disclosure and wherein.

DESCRIPTION OF THE PREFERRED EMBODIMENT

Figure 1:
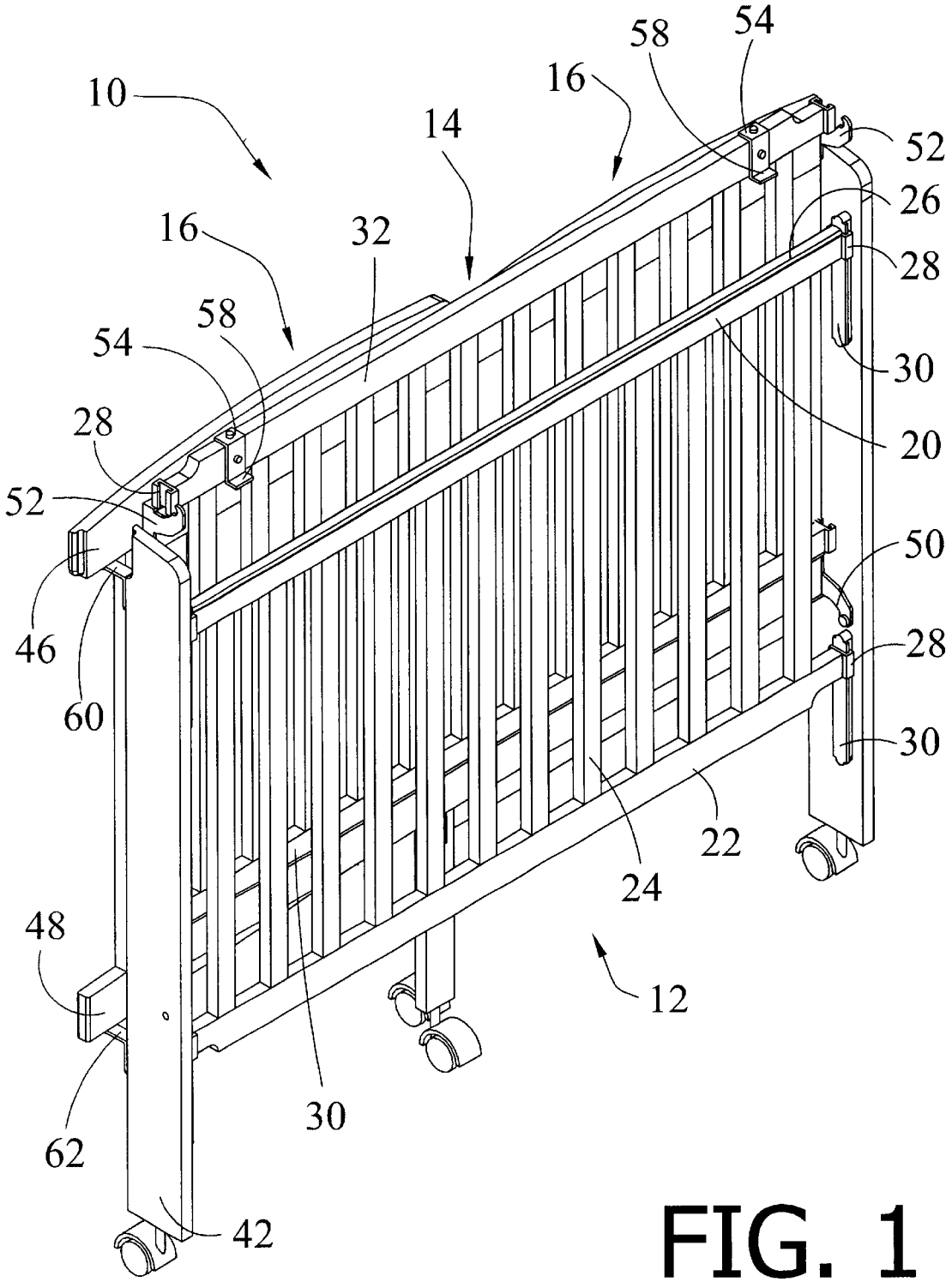
FIG. 1 is a perspective view of the preferred embodiment of a portable crib in a folded position.
Figure 2:
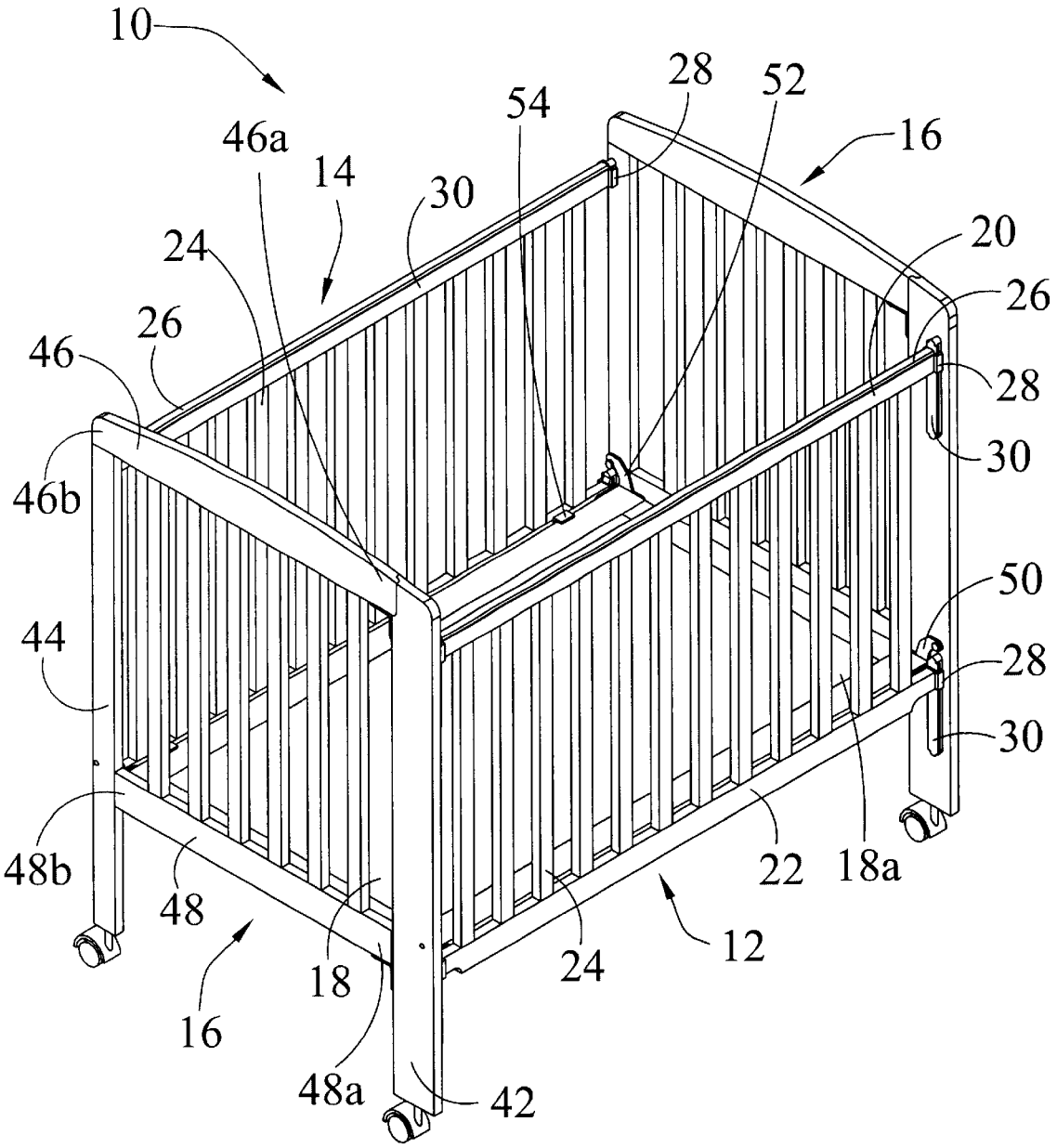
FIG. 2 is a perspective view of the preferred embodiment of a portable crib in an open position.

Referring to FIGS. 1–7 for a clearer understanding of the invention, it may be seen that the preferred embodiment of the foldable portable crib 10 comprises a freestanding folded crib, shown in the folded position on FIG. 1, which can be unfolded to form a sturdy and safe baby crib, shown in the open, useable position on FIG. 2. Referring to FIG. 2, it may be seen that the foldable portable crib 10 comprises a pair of opposing side assemblies, namely, a first side assembly 12 and a second side assembly 14, connected to a pair of opposing end assemblies 16 to form an improved baby crib frame. Positioned between the opposing side assemblies 12, 14 and the opposing end assemblies 16 is a mattress support platform 18 having an upper surface 18*a*, shown on FIG. 2, and a lower surface 18*b*, shown on FIG. 6.

In the preferred embodiment, the first side assembly 12 comprises a first side assembly upper rail 20 and a first side assembly lower rail 22 connected by a plurality of slats 24. Means for attaching the first side assembly 12 to the end assemblies 16 comprises guides 28, or glides, connected to the ends of the first side assembly upper 20 and lower 22 rails. The guides 28 slidably receive long tracks 30 attached to the inner surface of the end assemblies 16. The ends of the first side assembly 12 of the preferred embodiment are attached to the end assemblies 16, and remain attached thereto as the portable crib 10 is folded.

In the preferred embodiment, the first side assembly 12 functions as a drop side of the crib, and the first side assembly 12 is moveable along the long tracks 30 from an upper position to a lower, or drop position. The preferred embodiment of the present invention further comprises one or more latch assemblies (not shown) for securing the first side assembly 12 in predetermined positions along the tracks 30. In the preferred embodiment, the one or more latch assemblies lock the first side assembly 12 in an upper position, and a lower or drop position. Releasing the latch assemblies allows the first side assembly 12 to be moved between positions, after which the latch assemblies are locked to secure the first side assembly 12 in the selected position. The first side assembly further comprises a teething protector 26 covering the top surface of the first side assembly upper rail 20.

The second side assembly 14 is connected at its ends to the opposing end assemblies 16 when the crib 10 is in an open position as shown in FIG. 2. The second side assembly 14 is not moveable when the crib 10 is in an open position, and thus functions as a stationary side of the open crib 10. The second side assembly 14 comprises a second side assembly upper rail 30 and a second side assembly lower rail 32 connected by a plurality of slats 24. Similar to the first side assembly 12, means for attaching the second side assembly 14 to the end assemblies 16 comprises guides 28 connected to the ends of the second side assembly upper 30 and lower 32 rails. For the ends of the second side assembly upper rail 30, the guides 28 attached to the end of said upper rail 30 slidably receive short tracks 34 attached to the inner surface of the end assemblies 16. For the second side assembly lower rail 32, the guides 28 are slidably received in a guide seat 36 having a locking mechanism for maintaining the guides 28 in the guide seat 36. In the preferred embodiment, the locking mechanism comprises a spring-activated stop that is extended to secure the guides attached to the ends of the second side assembly lower rail 32 in the guide seat 36. Pressing the stop inwards allows the second side assembly lower rail 32 to be released from the guide seat 36 so that the second side assembly 14 can be detached from the end assemblies 16. Similar to the first side assembly, the second side assembly further comprises a teething protector 26 covering the top surface of the second side assembly upper rail 30.

Each of the opposing end assemblies 16 are bounded on each side by corner posts, namely, a first corner post 42 and a second corner post 44. With the crib 10 in the open position as shown in FIG. 2, the first side assembly 12 is connected at its ends to the first corner posts 42 and the second side assembly 14 is connected at its ends to the second corner posts 44. Each end assembly 16 comprises a top end rail 46 and a bottom end rail 48 having respective first ends 46*a*, 48*a* proximate the first corner post 42 and respective second ends 46*b*, 48*b* connected to the second corner post 44. The end assemblies 16 further comprise a plurality of slats 24 connecting the top end rail 46 and bottom end rail 48. The corner posts 42, 44 terminate at their lower ends in feet. In the preferred embodiment, the corner posts 42, 44 terminate in feet configured in the form of swivel caster wheels, which provide for easy mobility of the folded crib.

With reference to FIG. 2, it may be appreciated that with the preferred embodiment of the present invention in an open position, the first side assembly 12 and second side assembly 14 are connected to the end assemblies 16 in opposing relationship to form a generally rectangular crib frame with vertical sides. The frame and mattress support platform 18 is provided for supporting a mattress 19 to provide a juvenile crib.

Figure 7A:
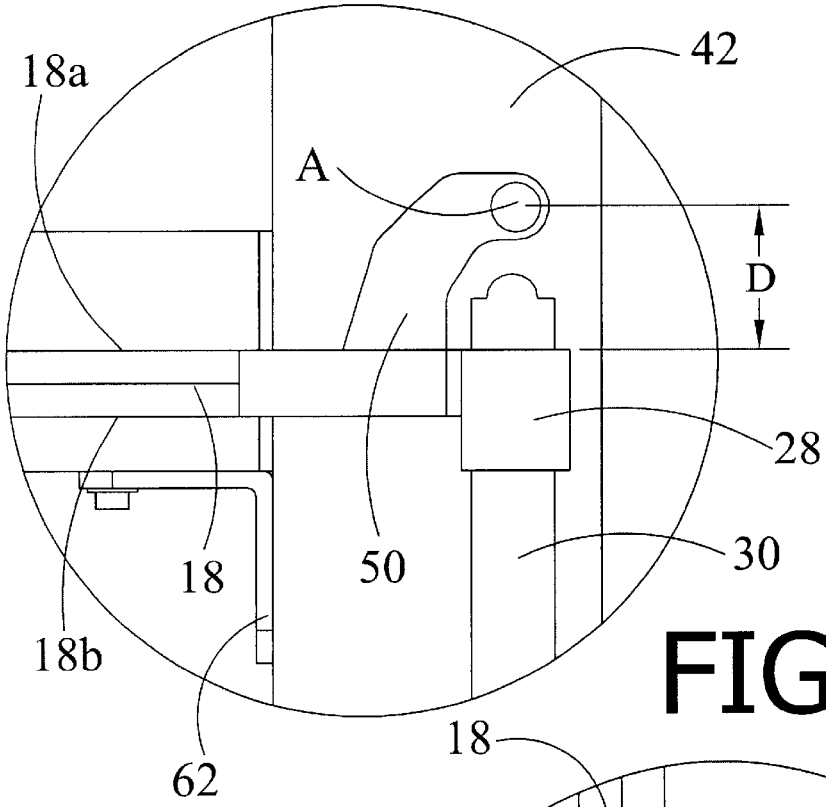
FIG. 7*a* is a side elevational view of the preferred embodiment of a portable crib showing a hinge bracket connected to a mattress support platform in an open position.
Figure 7B:
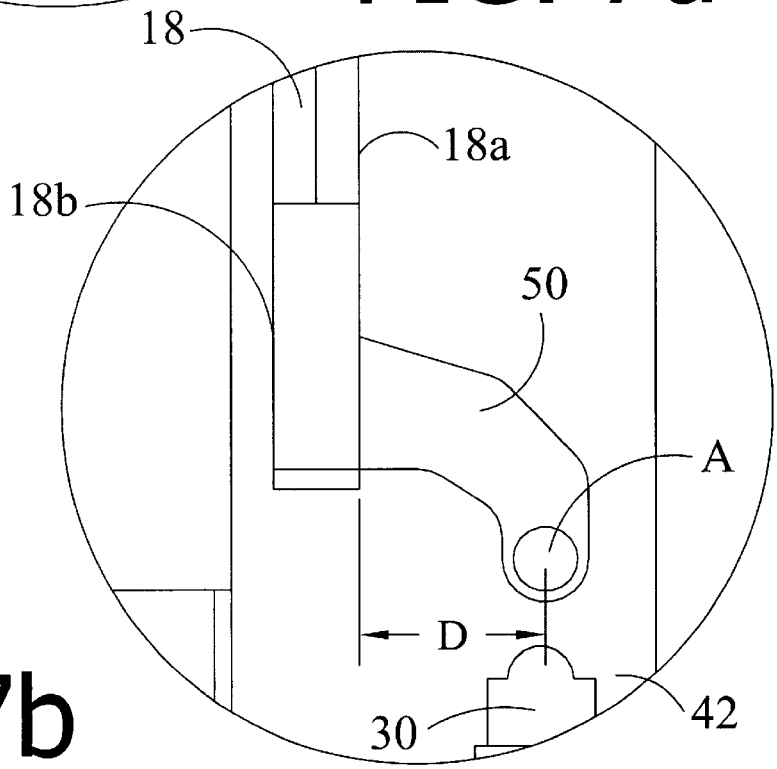
FIG. 7*b* is a side elevational view of the preferred embodiment of a portable crib showing a hinge bracket connected to a mattress support platform in a folded position.

Further comprising the present invention is a mattress support platform 18 having an upper surface 18*a* and a lower surface 18*b*, and means for pivotally mounting the platform 18 to the crib frame. As shown in FIG. 2, the platform 18 is positioned between the first and second side assemblies 12, 14 and the end assemblies 16 with the portable crib 10 in the open position. In the preferred embodiment, the platform 18 is pivotally mounted to the first corner posts 42. The means for pivotally mounting comprises hinge brackets 50 having a first end fixedly attached to the mattress platform 18 and a second pivotally connected to the first corner posts 42. With reference to FIGS. 2 and 7*a* showing the crib in the open position, the platform 18 is in a generally horizontal position. The second end of the hinge bracket 50 is pivotally attached to the corner post 42 so that it pivots a above a pivot point A positioned a predetermined distance D above the platform 18, as measured from the pivot point A along a line perpendicular to the plane defined by the upper surface 18*a* of the platform.

The invention further comprises means supporting the platform 18 to the second corner posts 44 when the crib 10 is in an open position. In the preferred embodiment, the means for supporting comprises a pin 51 extending from the inside surface of each of the second corner posts 44, and a pair of hook members 52 connected to the platform 18. The hook members 52 have a distal end 52*a* adapted and positioned for resting engagement on the respective pin 51. Each hinge bracket 50 is connected to the respective corner portions of the platform 18 proximate the first corner posts 42. Each hook member 52 is connected to the respective corner portions of the platform 18 proximate the second corner posts 44, so that each corner of the platform is supported by the respective corner posts, or legs of the crib 10, when the crib 10 is in an open position.

Figure 3:
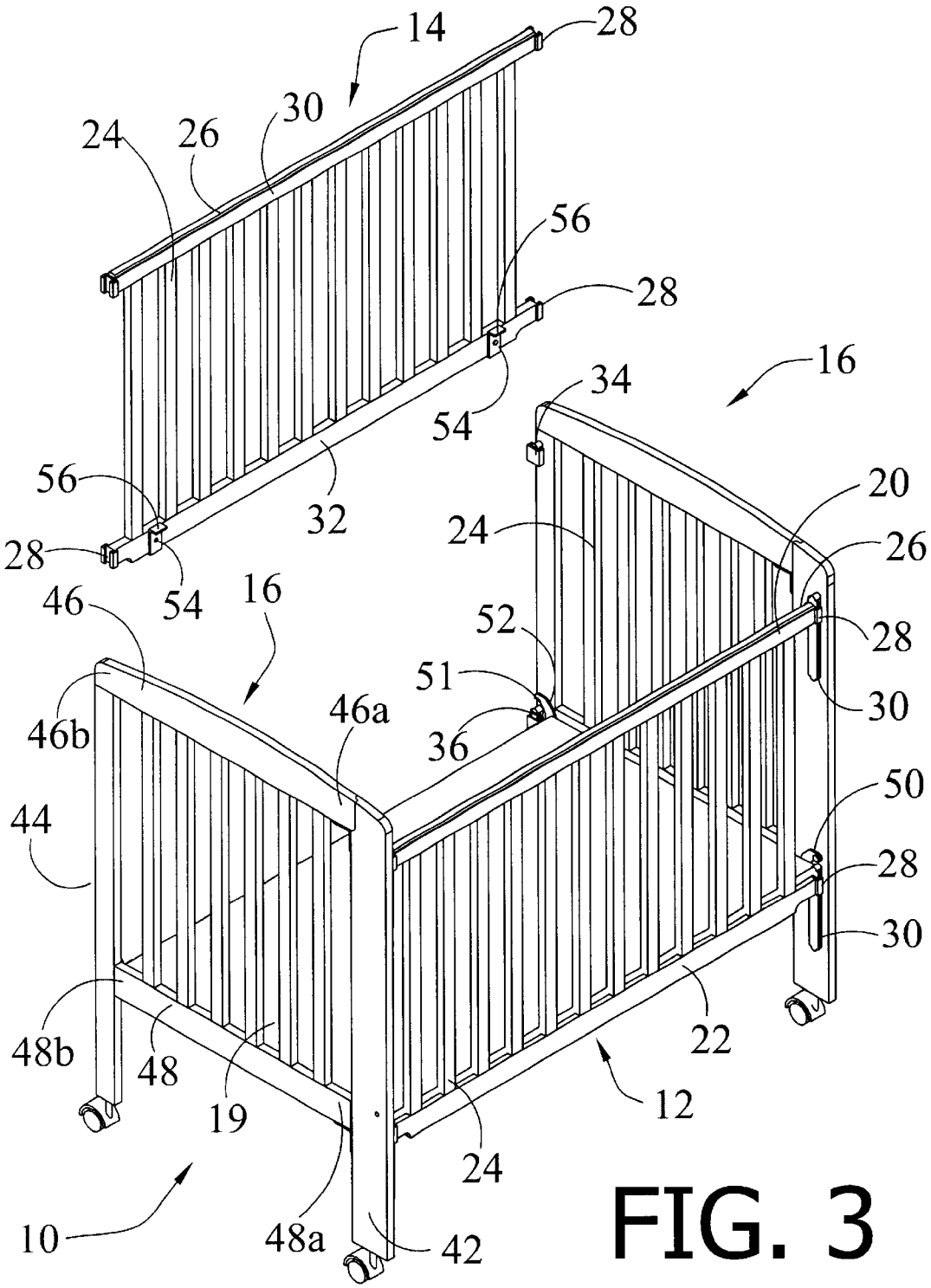
FIG. 3 is an exploded view of the preferred embodiment of a portable crib showing the second side assembly detached.

The manner in which the portable crib 10 of the present invention may be folded is described as follows, with reference to FIGS. 1–7 for a more complete understanding of the invention. With reference to FIG. 3, it can be seen that one step in folding the present invention from the open position to the folded position is detaching the second side assembly 14 from the end assemblies 16. This is accomplished by lifting the second side assembly 14 off of the short tracks 34 securing the upper rail 30 and off of the guide seats 36 securing the lower rail 32. This may be accomplished after releasing the locking stops to allow the second side assembly lower rail guides 28 to be removed from the guide seats 36.

Figure 4A:
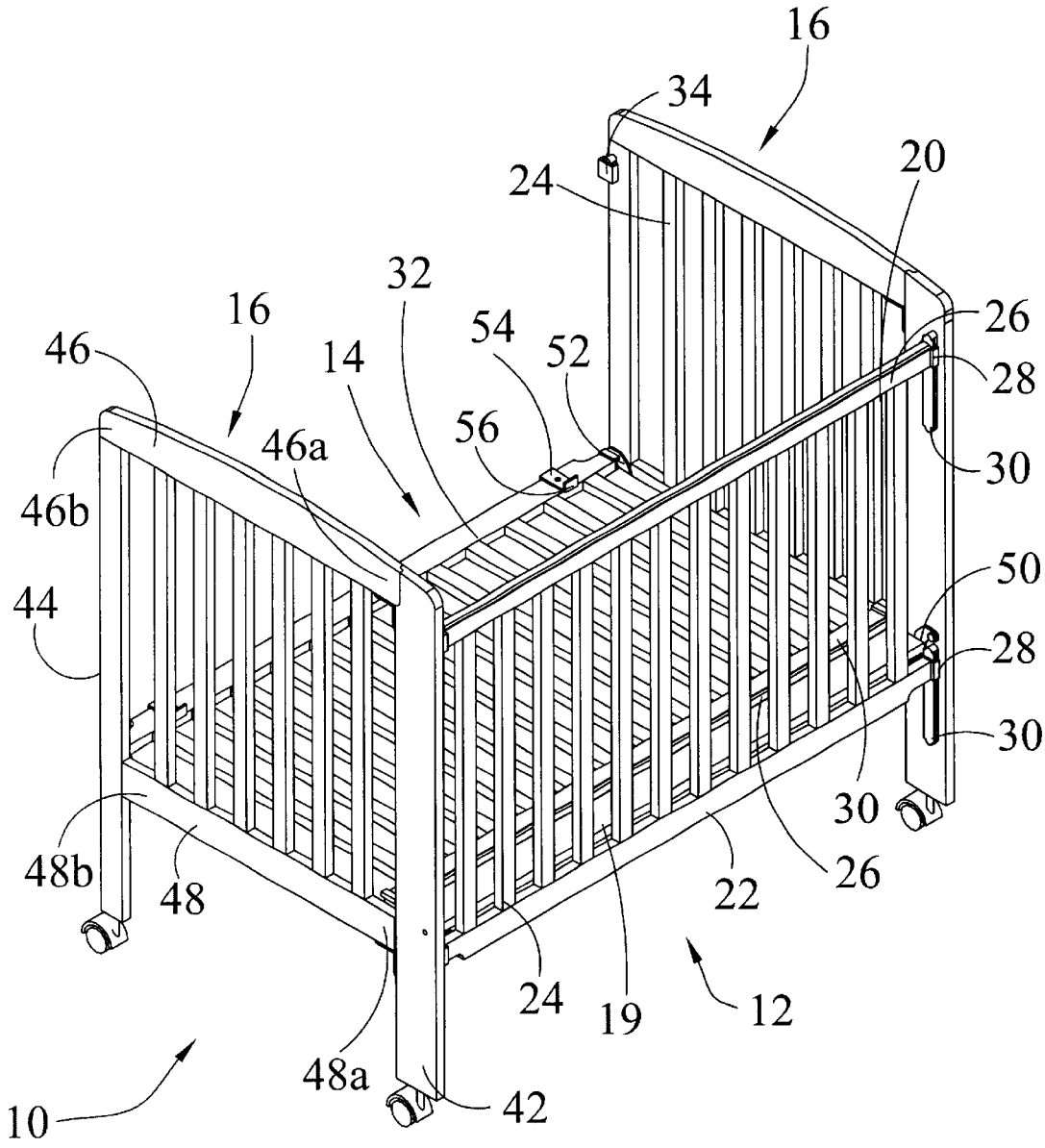
FIG. 4*a* is an exploded view of the preferred embodiment of a portable crib showing the second side assembly detached and placed on top of the mattress with the mattress support in an open position.
Figure 4B:
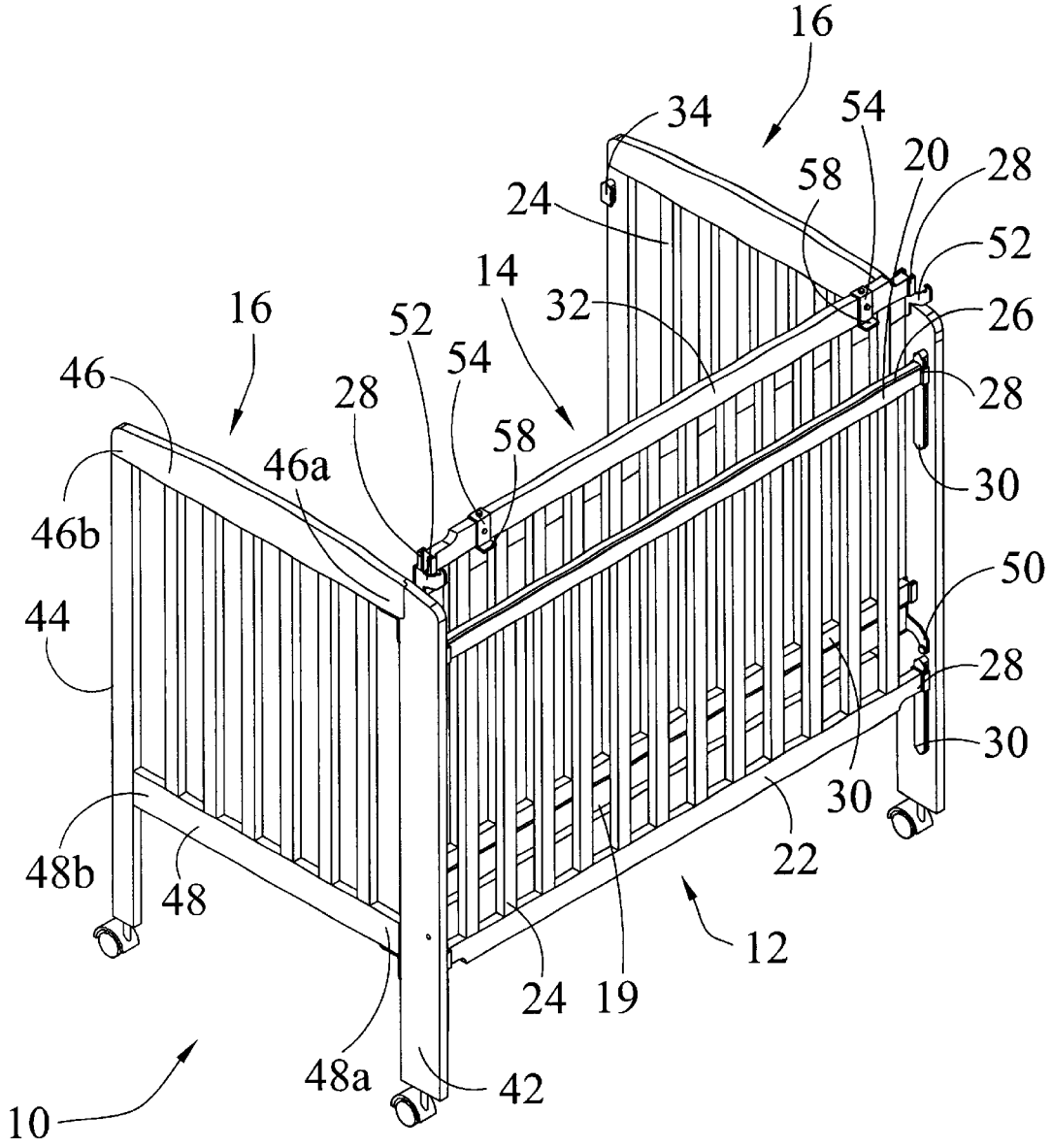
FIG. 4*b* is an exploded view of the preferred embodiment of a portable crib showing the second side assembly detached and the mattress support platform in a folded position.

As can be appreciated with reference to FIGS. 4*a* and 4*b*, after detaching the second side assembly 14 from the crib frame, another step in the folding process is pivotally moving the platform 18 from an open position wherein the platform 18 is in a generally horizontal position to a folded position wherein the platform 18 is in a generally vertical position. In the folded, or vertical position shown on FIGS. 4*b* and 7*b*, the vertical plane defined by the upper surface 18*a* of the platform is positioned in generally parallel relationship to the vertical plane defined by the inside surface of the first side assembly 12. Further, the upper surface 18*a* of the platform is facing the inside surface of the first side assembly 12. With reference to FIGS. 1, 4*b*, 7*a*, and 7*b*, it can be appreciated that the platform 18 is positioned a distance D from the pivot point A, measured along a line perpendicular to the plane defined by the upper surface 18*a* of the platform. In the folded position, the platform 18 is spaced from the first side assembly 12 a sufficient distance for placement of the second side assembly 14 and a mattress 19 of a type known in the art and sized for the crib therebetween. In this folded position, the mattress 19 serves to hold the second side assembly 14 in place by slight compression, so that the crib may be transported in a unitary configuration securely and without damage.

Figure 6:
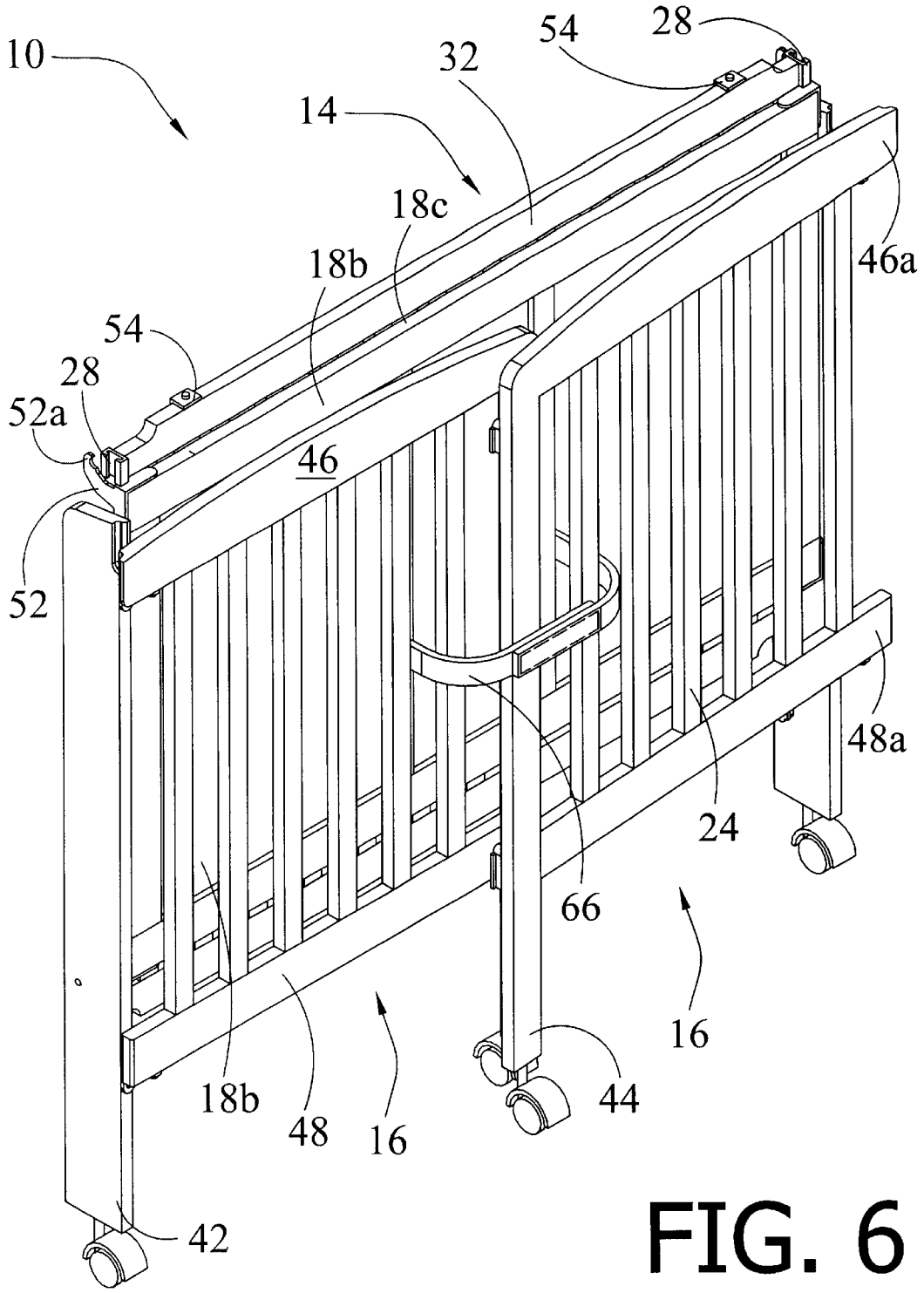
FIG. 6 is a second perspective view of the preferred embodiment of a portable crib in a folded position.

Another step in the folding process is placement of the second side assembly 14 between the platform 18 and first side assembly 12. To accomplish this step, the distance between the platform 18 and first side assembly 12 must be greater than the width of the second side assembly 14. In the preferred embodiment, the second side assembly 14 further comprises a pair of Z-shaped support brackets 54 attached to the inside surface of the second side assembly lower rail 32. The Z-shaped support brackets 54 are attached to the lower rail 32 with a flat portion extending therefrom, the flat portion having a first surface 56 and a second surface 58. In the open position, wherein the second side assembly 14 is attached to the end assemblies 16, the first surface 56 is facing upwards and the second surface 58 is facing downwards with at least a portion abutting the upper surface 18*a* of the platform, thus retaining the platform 18 in a generally horizontal position and preventing significant upward movement. In the closed position of the preferred embodiment, as shown in FIGS. 1 and 6, the second side assembly 14 is placed between the platform 18 and the first side assembly 12 in the following manner. After its removal, as shown in FIG. 4*a*, the second side 14 is rotated 180 degrees so that the upper rail 30 is at the bottom and the lower rail 32 is at the top. It is then placed on top of the mattress 19, with the mattress support platform 18 in the open position, the second side 14 being oriented so that the upper rail 30 of the second side assembly 14 is proximate to the first side 12 and the Z-shaped brackets 54 are facing upward. Then the platform 18, mattress 19, and second side 14 re rotated upward together to the folded position, as shown in FIG. 4*b*. Lastly, the end assemblies 16 are folded inward in an overlapping relationship and secured using straps 66 attached to the lower surface 18*b* of the platform, as shown in FIGS. 1 and 6. In this manner, the second side assembly 14 is stowed between the platform 18 with mattress 19 and the first side assembly 12, with the inside surface of the second side assembly 14 facing the inside surface of the first side assembly 12. In the folded position, the second side assembly 14 is stowed upside-down.

The present invention further comprises hinge means for pivotally moving a portion of the end assemblies 16 about the first corner posts 42. In the preferred embodiment, the portion of the end assemblies 16 that is pivotally moveable about the first corner posts 42 comprise an upper end rail 46 and a lower end rail 48. This portion of the end assemblies 16 pivotally connected to the first corner posts 42 and pivotally moveable about the first corner posts 42 may be described as end rail assemblies having a first end proximate the first corner posts 42 and a second end. Hinge means for pivotally moving the end rail assemblies comprises upper swivel brackets 60 pivotally connecting the upper end rails 46 to the first corner posts 42, and lower swivel brackets 62 pivotally connecting the lower end rails 48 to the first corner posts 42

The upper swivel brackets 60 are fixedly attached to the first corner posts 42, and pivotally connected to the upper end rail 46, so that the upper end rail 46 is pivotally moveable about a pivot point. Similarly, the lower swivel brackets 62 are fixedly attached to the first corner posts 42 and pivotally connected to the lower end rail 48 so that the lower end rail is pivotally moveable about a pivot point. With reference to FIGS. 1, 4*b*, 5*a*, 5*b*, and 6, it can be seen that in the preferred embodiment the end rail assemblies are pivotally moveable from an open position shown on FIG. 4*b* to a folded position wherein the end assemblies are folded against the lower surface 18*b* of the platform with at least a portion of one end assembly in abutment therewith. In the preferred embodiment, the folded portable crib shown in FIGS. 1 and 6 has end assemblies folded in overlapping relationship.

The preferred embodiment of the present invention further comprises means for securing the end assemblies in the folded position, comprising straps 66 attached to the lower surface 18*b* of the platform. As shown on FIG. 6, the straps 66 pass through slats 24 in the respective end assemblies and connected to one another to maintain the end assemblies in folded relationship. It can be seen that the present invention is folded to assume a unitary, generally narrow configuration that facilitates movement and storage of the folded crib. Further, the portable crib of the present invention can set up from a compact, unitary folded position into an open, usable position in a short period of time.

Figure 5A:
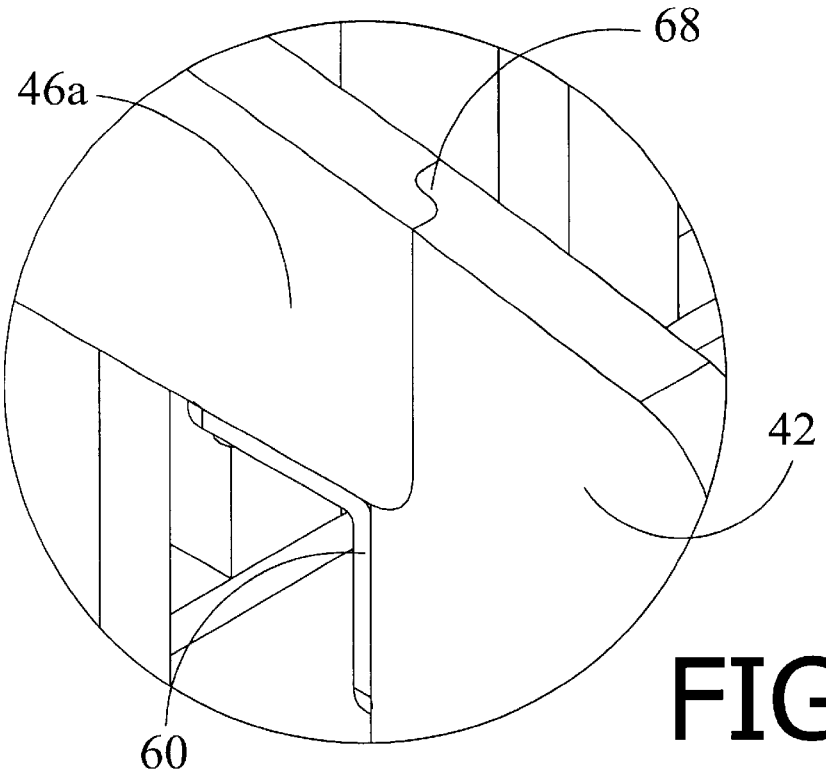
FIG. 5*a* is a perspective view of the preferred embodiment of a portable crib showing a hinge joint in a closed position.
Figure 5B:
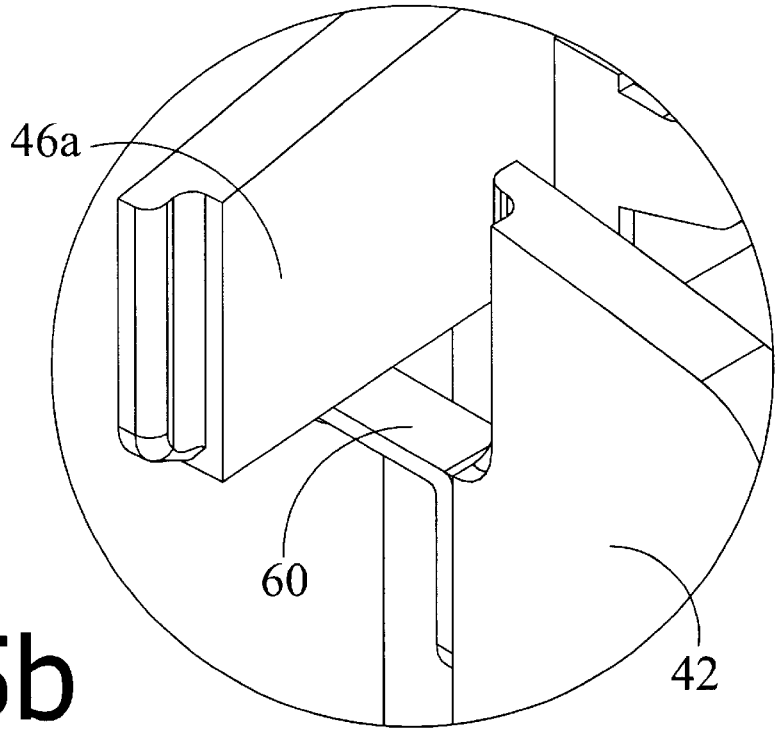
FIG. 5*b* is a perspective view of the preferred embodiment of a portable crib showing joint in an open position.

The present invention further comprises means for stabilizing the end assemblies and corner posts 42 when the end assemblies are in an open position. In the preferred embodiment, as shown in FIGS. 5*a* and 5*b*, means for stabilizing comprises a curved hinge joint 68 formed in the first end 46*a* of the upper end rail and a portion of the first corner post 42. The curved hinge joint 68 comprises a curved portion formed at the first end 46*a* of the upper end rail, as shown in FIG. 5*b*, and a curved portion formed in the corner post 42 for mating engagement with the first end 46*a* of the upper end rail with the end assemblies in an open position. The hinge joint stabilizes the end rail assemblies when the crib 10 is in an open position, causing the end rail assembly to be locked securely into position when the end rail assemblies are open. This prevents the possibility of undue flexing at the hinge location, which could otherwise contribute to the instability of the open crib as a whole. This locked position is maintained by attachment of the second side rail assembly 14 to the end assemblies 16, which keeps the end rail assemblies in an open position, and by close-fitting (snug, tight) attachment of the large round ends of the hinge brackets 50 to the first corner posts 42. As shown in FIG. 5*a*, the hinge joint 68 is generally S-shaped and locks into an open position to form a continuous outer surface between the upper end rail 46 and corner post 42. The continuous upper and side surfaces formed by the hinge joint 68 in the open position eliminate pinch points and catch points at the hinge location. In addition to providing greater structural support and eliminating dangerous pinch and catch points, the smooth transition from the upper end rail 46 to the first corner post 42 improves the appearance of the crib. The hinge joint 68 of the present invention provides enhanced rigidity and stability when the crib is in the open, usable position.

The preferred embodiment of the present invention has first corner posts 42 that are sufficient in width to allow for the placement of the second side assembly 14 in a stowed position. As shown in FIGS. 1 and 2, the end rail assemblies pivot about the first corner posts 42, and the corner posts have a width sufficient to allow positioning of the mattress support platform 18, the second side rail assembly 14 and the mattress 19 between the first side rail assembly 12 and the end rail assemblies 16 when the crib 10 is in a folded position. It may be seen that the width of the first corner posts 42 allows for connection of the first side rail assembly 12 to the corner posts and pivotal connection of the end rail assemblies to the corner posts 42 so that there is sufficient space for stowing the second side rail assembly 14 and mattress 19 when the crib 10 is in a folded position. As shown in FIG. 2, in the preferred embodiment the first corner posts 42 are greater in width than the second corner posts 44, the width being measured along a horizontal line positioned along the outer facing surface of the end assemblies 16, perpendicular to side rail assemblies 12, 14. The preferred embodiment further comprises casters attached to the bottom of the first and second corner posts 42, 44, which allow the crib 10 to be easily moved in either the open or folded position.

It is to be understood that the form of the invention shown is a preferred embodiment thereof and that various changes and modifications may be made therein without departing from the spirit of the invention or scope as defined in the following claims.

What is claimed is:

1. A folded portable crib comprising in combination:

a) a pair of opposing end assemblies, each said end assembly bounded by a first corner post and a second corner post, b) a first side assembly connected at its ends to said first corner posts, c) a mattress support platform having an upper surface and a lower surface, d) means for pivotally mounting said platform to said corner posts, e) a second side assembly positioned between said platform and said first side assembly, and f) means for attaching said second side assembly to said second corner posts.

2. A folded portable crib as described in claim 1 further comprising a mattress sized for the crib.

3. A folded portable crib as described in claim 2 wherein said platform is moveable between an open position wherein said platform is in a generally horizontal position to a folded position wherein said platform is in a generally vertical position.

4. A folded portable crib as described in claim 3 wherein said platform is spaced from said first side assembly in said folded position a sufficient distance for placement of said mattress and said second side assembly therebetween.

5. A folded portable crib as described in claim 4 wherein said first corner posts are wider than said second corner posts.

6. A folded portable crib as described in claim 3 further comprising means for supporting said platform in said open position to said second corner posts.

7. A folded portable crib as described in claim 6 wherein said means for supporting comprises a pin extending from each of said second corner posts and a pair of hook members connected to said platform, each said hook member having a distal end positioned for seating engagement on said pin.

8. A folded portable crib as described in claim 1 wherein said means for pivotally mounting comprises hinge brackets fixedly connected to said platform and pivotally connected to said first corner posts.

9. A folded portable crib as described in claim 1 wherein said end assemblies further comprise hinge means for pivotally moving a portion of said end assemblies about said first corner posts.

10. A folded portable crib as described in claim 9 wherein said end assemblies comprise an upper end rail and a lower end rail and said hinge means comprises upper swivel brackets pivotally connecting said upper end rails to said first corner posts, and lower swivel brackets pivotally connecting said lower end rails to said first corner posts.

11. A folded portable crib as described in claim 10 wherein said end assemblies are moveable from a folded position wherein said end assemblies are folded against said lower surface of said platform with at least a portion of one end assembly in abutment therewith.

12. A folded portable crib as described in claim 11 wherein said end assemblies are folded in overlapping relationship in said folded position.

13. A folded portable crib as described in claim 11 further comprising means for stabilizing said end assemblies and said corner posts when said end assemblies are in an open position.

14. A folded portable crib as described in claim 13 wherein said means for stabilizing comprises a hinge joint having a curved portion formed in said upper end rails matingly engaging a curved portion of said first corner posts.

15. A folded portable crib as described in claim 14 wherein said hinge joint is S-shaped.

16. A folded portable crib as described in claim 14 wherein said hinge joint forms a continuous surface between said corner posts and said upper end rails.

17. A folded portable crib as described in claims 10 or 11 further comprising means for securing said end assemblies in said folded position.

18. A folded portable crib as described in claim 17 wherein said means for securing comprises straps attached to said lower surface of said platform.

19. A foldable portable crib comprising in combination:

a) a pair of first corner posts, b) a pair of opposing end rail assemblies, each said end rail assembly having a first end hingedly mounted to one of said first corner posts, and a second end, c) a first side assembly connected at its ends to said first corner posts, d) a second side assembly, and e) a mattress support platform pivotally mounted to said first corner posts, said end rail assemblies and said platform being moveable from an open position wherein said second side assembly is connected at its ends to said second ends of said end rail assemblies, to a folded position wherein said second side assembly and said platform are interposed between said first side assembly and said rail assemblies.

20. A foldable portable crib as described in claim 19 further comprising a mattress sized for the crib, said mattress being interposed between said platform and said second side assembly in said folded position.

21. A foldable portable crib as described in claim 20 wherein said platform is spaced from said first side assembly in said folded position a sufficient distance for placement of said mattress and said second side assembly therebetween.

22. A foldable portable crib as described in claim 20 further comprising means for pivotally mounting said mattress support platform to said first corner posts.

23. A foldable portable crib as described in claim 22 wherein said means for pivotally mounting comprises hinge brackets fixedly connected to said platform and pivotally connected to said first corner posts.

24. A foldable portable crib as described in claim 22 further comprising means for supporting said platform in said open position to said end rail assemblies.

25. A foldable portable crib as described in claim 20 further comprising hinge means for pivotally moving said end rail assemblies about said first corner posts.

26. A foldable portable crib as described in claim 25 wherein said hinge comprises a hinge joint having a curved portion formed in said first end of said end rail assembly and a curved portion in said first corner post for mating engagement therebetween.

27. A foldable portable crib as described in claim 26 wherein said hinge joint forms a continuous surface between a portion of said first end of said end rail assembly and a portion of said first corner post.

28. A foldable portable crib as described in claim 26 wherein said hinge joint is S-shaped.

29. A foldable portable crib as described in claim 20 wherein said end rail assemblies are folded against said lower surface of said platform with at least a portion of one end assembly in abutment therewith.

30. A foldable portable crib as described in claim 29 wherein said end rail assemblies are folded in overlapping relationship in said folded position.

31. A foldable portable crib as described in claim 30 further comprising means for securing said end rail assemblies in said folded position.

32. A foldable portable crib as described in claim 31 wherein said means for securing comprises straps attached to said lower surface of said platform.

* * * * *